United States Patent [19]

DuBois

[11] Patent Number: 4,617,196

[45] Date of Patent: Oct. 14, 1986

[54] METHOD FOR TREATING CATHODE

[75] Inventor: Donald W. DuBois, Akron, Ohio

[73] Assignee: PPG Industries, Inc., Pittsburgh, Pa.

[21] Appl. No.: 743,186

[22] Filed: Jun. 10, 1985

[51] Int. Cl.[4] ..... B05D 5/12

[52] U.S. Cl. ..... 427/123; 427/352; 156/656; 156/664; 156/665; 502/101

[58] Field of Search ..... 427/123, 352; 156/656, 156/664, 665; 502/101

[56] References Cited

U.S. PATENT DOCUMENTS

| | | | |
|---|---|---|---|
| 3,637,437 | 1/1972 | Goldberger | 136/120 FC |
| 4,169,025 | 9/1979 | Needes | 204/98 |
| 4,240,895 | 12/1980 | Gray | 204/290 R |
| 4,349,612 | 9/1982 | Baldi | 428/607 |
| 4,415,416 | 11/1983 | Kadija | 204/147 |
| 4,443,557 | 4/1984 | Baldi | 502/301 |

*Primary Examiner*—Richard Bueker

*Attorney, Agent, or Firm*—Bruce H. Cottrell

[57] ABSTRACT

Disclosed is a method of treating a porous Raney nickel electrode having pyrophoric properties to eliminate such properties while maintaining the catalytic properties of the electrode. The method includes coating an active porous Raney nickel electrode with an aqueous solution consisting essentially of 4 to 50 weight percent alkali metal hydroxide and exposing the coated electrode to air for a period of time sufficient to eliminate the pyrophoric tendencies of the electrode. Also disclosed is a method of activating and depyrophorizing a nickel-aluminum coated electrode by immersing the electrode in an aqueous solution of alkali metal hydroxide to leach the aluminum and activate the electrode and then maintaining a film or coating of the alkali metal hydroxide upon the leached electrode and exposing the coated electrode to air until the electrode is depyrophorized.

19 Claims, No Drawings

METHOD FOR TREATING CATHODE

BACKGROUND OF THE INVENTION

The present invention relates to nickel cathodes. More particularly, this invention relates to methods of treating nickel cathodes to prevent pyrophoricity.

Alkali metal hydroxide and chlorine are commercially produced by electrolyzing an alkali metal chloride brine, for example, an aqueous solution of sodium chloride or an aqueous solution of potassium chloride. The alkali metal chloride solution is fed into the anolyte compartment of an electrolytic cell, a voltage is imposed across the cell, chlorine is evolved at the anode, alkali metal hydroxide is evolved in the catholyte, and hydrogen is evolved at the cathode.

While iron or mild steel has often been used as the cathode in conventional commercial chlorine cells, it has been found that a reduction in hydrogen overvoltage may be realized by utilizing a cathode having a porous high surface area coating, e.g., porous Raney nickel. Use of such a porous Raney nickel cathode coating can produce a significant savings in energy consumption and cost.

Generally, a porous Raney nickel coated electrode is formed by depositing a nickel-aluminum alloy layer upon a metal substrate followed by a selective leaching step wherein sufficient aluminum is removed to form an active high surface area nickel layer. A strong aqueous base, such as sodium hydroxide or potassium hydroxide, capable of dissolving aluminum is used in the selective leaching step. After selective leaching, active nickel coatings exhibit a tendency to heat upon exposure to air. This self-heating tendency can lead to problems of pyrophoricity. Self-heating pyrophoric cathodes can be hazardous to personnel working with such electrolytic cells. Further, such heating can cause damage to the cathode substrate itself or in an electrolytic membrane cell cause damage to the ion exchange membrane.

A number of methods have been developed to lessen the sensitivity of porous Raney nickel coated electrodes to air. It has been suggested to treat such electrodes with a dilute aqueous solution containing a chemical oxidizing agent, for example, solutions containing by weight, (a) 3 percent sodium hypochlorite and 10 percent sodium hydroxide, (b) 3 percent sodium nitrate, or (c) 3 percent potassium dichromate. Treatment with a dilute solution of hydrogen peroxide has also been proposed to reduce the pyrophoric tendency of such an electrode.

DESCRIPTION OF THE INVENTION

According to the invention herein contemplated, an active porous nickel coated electrode is treated by maintaining a coating of an aqueous solution consisting essentially of alkali metal hydroxide, generally about 1 to 70 weight percent alkali metal hydroxide and preferably about 4 to 50 weight percent alkali metal hydroxide on the porous nickel coated electrode in an oxygen-containing gas for a period of time sufficient to prevent or substantially reduce pyrophoricity of the porous nickel coating. According to a further exemplification of the invention herein contemplated, a process of activating and depyrophorizing a nickel-aluminum coated electrode comprises immersing the nickel-aluminum coated electrode in an aqueous solution of alkali metal hydroxide thereby leaching aluminum from the nickel-aluminum coated and activating the electrode, removing the activated electrode from the alkali metal hydroxide solution whereby a film consisting essentially of alkali metal hydroxide remains on the electrode, and maintaining the film upon the porous nickel coating while exposing the alkali metal hydroxide coated electrode to oxygen-containing gas for a period of time sufficient to depyrophorize the electrode.

DETAILED DESCRIPTION OF THE INVENTION

In the process of the present invention, an active porous nickel coated electrode having pyrophoric properties is treated by maintaining a coating of an aqueous solution consisting essentially of alkali metal hydroxide, generally about 1 to 70 weight percent alkali metal hydroxide and preferably about 4 to 50 weight percent alkali metal hydroxide on a leached active nickel coated electrode in oxygen-containing gas, e.g., air for a period of time sufficient to prevent or substantially reduce such pyrophoric properties by the nickel coated electrode. The porous nickel coated electrode will retain its catalytic activity after the treatment, but will lose its pyrophoric tendencies. By catalytic activity is meant that the porous nickel coated electrode has a lower hydrogen overvoltage than an uncoated electrode. While not wishing to be bound by any particular theory, it is believed that the alkali metal hydroxide coating controls oxygen diffusion from the air through the coating thereby reducing oxygen flux to the active nickel coating and allowing a slower oxidation of the nickel coating. This slower oxidation prevents the electrode from undergoing a rapid rise in temperature.

The preparation of a Raney nickel electrode involves forming a highly porous nickel surface upon a metallic substrate. The metallic substrate is coated with an alloy of nickel and a sacrificial metal. The alloy of nickel and sacrificial metal may include other transition metals such as molybdenum, ruthenium, tantalum, titanium, rhodium, cobalt, platinium, osmium, iridium, alloys of such metals, and mixtures of such metals and metal alloys. The sacrificial metal may also be described as a leachable metal and can be aluminum or zinc.

The substrate is electroconductive and may be a perforated sheet, a perforated plate, metal mesh, expanded metal mesh, metal rods or the like. The substrate is typically comprised of iron or an iron alloy. By iron alloy is meant a carbon steel or an alloy of iron with manganese, phosphorous, cobalt, nickel, chromium, molybdenum, vanadium, palladium, titanium, zirconium, niobium, tantalum, tungsten or carbon. Alternatively, the substrate can be cobalt, nickel, molybdenum, tungsten or other alkali metal hydroxide resistant metals.

The Raney nickel alloy coating can be codeposited upon the substrate by electrodeposition, chemical deposition, flame spraying, plasma spraying, ion bombardment, coating or spraying of slurries or suspensions, thermal decomposition of organometallics, or even thermal diffusion of one metal into another.

After the metallic substrate is coated with the Raney nickel alloy, at least a portion of the sacrificial metal is removed by leaching whereby to yield an active porous surface, film, coating or layer. The leaching of the sacrificial metal is carried out by means well-known in the art, i.e., by immersion of the cathode in an alkali medium prior to cell assembly.

The alkali medium can be any strong aqueous base such as sodium hydroxide or potassium hydroxide or other strongly basic solution capable of leaching or dissolving the sacrificial metal. The alkali medium is preferably an aqueous base such as sodium hydroxide or potassium hydroxide. The aqueous sodium or potassium hydroxide solution used for leaching the sacrificial metal can generally be from 1 to 50 weight percent. By active porous surface is meant that the surface, film, coating or layer has high electrochemical activity. That is, the active porous surface has a low overvoltage as compared to the substrate.

The resulting porous surface, film, layer or coating has a porosity of from about 35 to about 80 percent, generally from about 50 to about 75 percent. Unfortunately, this resulting porous surface, film, layer or coating can exhibit pyrophoric properties. By pyrophoric, is meant that exposure to air can result in a significant increase in temperature by the porous nickel coating.

The active leached nickel electrode is then treated further with an aqueous solution consisting essentially of alkali metal hydroxide, generally about 1 to 70 weight percent alkali metal hydroxide and preferably about 4 to 50 weight percent alkali metal hydroxide to provide a coating. The alkali metal hydroxide coating can be sodium hydroxide or potassium hydroxide, preferably sodium hydroxide. An aqueous solution consisting essentially of from 8 to 30 weight percent alkali metal hydroxide can conveniently be employed as the coating and is highly preferable. Weight percents greater than 50 percent are possible in the process but are not commonly utilized.

The alkali metal hydroxide coating is maintained on the active nickel electrode in air for at least 4 hours. Generally, the period of time sufficient to eliminate or substantially reduce pyrophoric problems is from 4 to 20 hours with a coating of an aqueous solution consisting essentially of 4 to 50 weight percent sodium hydroxide. The alkali metal hydroxide coating can absorb water from the air and thereby maintain a moist coating. This may also result in the weight percent of the alkali metal hydroxide varying slightly depending on the moisture content of the surrounding gas. The coated electrode can generally be maintained at ambient temperature during this period, generally from 10° C. to 40° C.

In an embodiment of the present invention, a nickel-aluminum coated electrode can be activated and depyrophorized by immersing the nickel-aluminum coated electrode in an aqueous solution consisting essentially of alkali metal hydroxide, generally about 1 to 70 weight percent alkali metal hydroxide and preferably about 4 to 50 weight percent alkali metal hydroxide, thereby leaching aluminum from the nickel-aluminum coating and activating the electrode coating, removing the activated, leached electrode from the alkali metal hydroxide solution, allowing a film consisting essentially of the alkali metal hydroxide to remain on the electrode, and exposing the alkali metal hydroxide coated electrode to oxygen-containing gas, e.g., air for a period of time sufficient to depyrophorize the electrode.

The nickel-aluminum coated electrode can be immersed in the alkali metal hydroxide for a period of from 2 to 24 hours to leach the aluminum and activate the porous electrode. The leaching is conducted at a temperature of from 20° C. to 95° C., preferably 25° C. to 60° C. The film of aqueous alkali metal hydroxide should be maintained on the electrode for a period of at least four hours, preferably from 4 to 20 hours during which time the alkali metal hydroxide coated electrode is exposed to air. Following this period of exposure the alkali metal hydroxide coating is rinsed from the porous nickel electrode, e.g., by water and the electrode dried, e.g., by further exposure to air.

In another embodiment of this invention, active porous nickel is treated to prevent or substantially reduce pyrophoricity by coating the active porous nickel with a liquid film and exposing the coated porous nickel to air for a period of time sufficient to depyrophorize the nickel. The liquid film can be an aqueous solution consisting essentially of alkali metal hydroxide, generally about 1 to 70 weight percent alkali metal hydroxide and preferably about 4 to 50 weight percent alkali metal hydroxide. Also, the liquid film can be an organic material capable of preserving a wet film upon the porous nickel. The organic material can be a material having a low volatility or a low vapor pressure. Preferably, the film material should be nonflammable. The organic material can be, for example, a hygroscopic material such as ethylene glycol, glycerol, 1,3-butylene glycol, 1,4-butylene glycol, 2,3-butylene glycol and the like. Similarly, the liquid film can comprise an aqueous solution of a non-oxidizing inorganic material. The non-oxidizing material coats or covers the active porous nickel but will not undergo any significant chemical reaction with the active porous nickel, i.e., it is chemically inert to the porous nickel. Non-oxidizing materials can include inorganic salts, such as alum, i.e., aluminum ammonium sulfate, aluminum potassium sulfate, or aluminum sulfate, and a silicate, e.g., sodium silicate.

The liquid film is maintained on the active nickel in air for a period of time sufficient to depyrophorize the nickel. Generally, exposing the liquid film coated active nickel to air for at least four hours can eliminate the pyrophoric tendencies. Preferably the liquid film is maintained on the active nickel for from 4 to 20 hours.

The present invention is illustrated by the following example which is illustrative only.

EXAMPLE I

A fine expanded-mesh nickel substrate was electro-arc sprayed with a nickel wire clad with aluminum to form a nickel-aluminum coated electrode, i.e., cathode. The coating loading was 0.149 pounds per square foot on a cathode sample measuring 2 inches by 2 inches. The aluminum was dissolved by leaching in an aqueous solution consisting essentially of about 4 weight percent sodium hydroxide for a period of from 3 to 4 hours. After the leaching, a high porosity, high surface area nickel coating remained. This active nickel coated electrode was immediately coated with an aqueous solution consisting essentially of about 25 weight percent sodium hydroxide by soaking the electrode in aqueous 25 weight percent sodium hydroxide solution. The electrode was removed from the sodium hydroxide solution, dried with a paper towel, mounted on a stand and exposed to air. During the exposure to air, a sodium hydroxide coating remained upon the active nickel coated electrode. After a period of 18 hours, the activated cathode was rinsed with distilled water to remove the sodium hydroxide and dried with a paper towel. No exotherm was observed upon drying in air.

In comparison, an activated cathode prepared as in Example I was allowed to soak in an aqueous solution consisting essentially of 25 weight percent sodium hydroxide for 15 minutes. The cathode was removed from the solution, dried with a paper towel and placed in a holder with a piece of a ion exchange membrane (Flemion® 723 available from Asahi Glass Co.) against the active face of the cathode. After 3 hours, there was no heating of the cathode. The cathode was then washed with distilled water and redried with a paper towel. In about 30 seconds, the cathode showed an exotherm in measurements with a thermocouple. The three hour exposure of this sodium hydroxide coated cathode was not sufficient time to prevent pyrophoricity of the cathode.

The process of this invention demonstrates that the pyrophoric properties of an active porous nickel coated electrode can be eliminated or substantially reduced by treating the activated porous nickel electrode with an aqueous solution consisting essentially of about 4 to 50 weight percent alkali metal hydroxide and maintaining a coating of this solution on the active nickel electrode in air for a period of time sufficient to prevent pyrophoricity of the nickel electrode.

Obviously, many modifications and variations of the present invention are possible in light of the above disclosure. It is, therefore, to be understood that, within the scope of the appended claims, the invention may be practiced otherwise than as specifically described.

I claim:

1. In the process of preparing a porous nickel electrode comprising forming a layer of nickel and a sacrificial metal upon a metal substrate, selectively leaching sacrificial metal from the nickel-containing layer, thereby activating the nickel electrode, and treating the electrode to prevent pyrophoricity, the improvement wherein treatment of the electrode comprises maintaining a coating of an aqueous solution consisting essentially of about 4 to 50 weight percent alkali metal hydroxide on the leached nickel electrode while exposing the coated electrode to an oxygen-containing gas for a period of time sufficient to depyrophorize the nickel electrode.

2. The process of claim 1 wherein the sacrificial metal is aluminum.

3. The process of claim 1 wherein the alkali metal hydroxide coating is maintained on the leached nickel electrode while exposing the coated electrode to oxygen-containing gas for at least 4 hours.

4. The process of claim 2 wherein the alkali metal hydroxide coating is maintained on the leached nickel electrode while exposing the coated electrode to oxygen-containing gas for at least 4 hours.

5. The process of claim 1 wherein the alkali metal hydroxide is sodium hydroxide.

6. The process of claim 2 wherein the alkali metal hydroxide is sodium hydroxide.

7. The process of claim 3 wherein the alkali metal hydroxide is sodium hydroxide.

8. The process of claim 4 wherein the alkali metal hydroxide is sodium hydroxide.

9. A process of activatingand depyrophorizing a nickel-aluminum coated electrode comprising:

a. immersing the nickel-aluminum coated electrode in an aqueous solution consisting essentially of about 4 to 50 weight percent alkali metal hydroxide, thereby leaching aluminum from the nickel-aluminum coating and forming a porous nickel coating;

b. removing the leached electrode from the alkali metal hydroxide solution, whereby a film consisting essentially of alkali metal hydroxide remains on the electrode;

c. maintaining the film in contact with the porous nickel coating while exposing the coated electrode to oxygen-containing gas for a period of time sufficient to depyrophorize the electrode.

10. The process of claim 9 wherein the alkali metal hydroxide is sodium hydroxide.

11. The process of claim 9 wherein the oxygen-containing gas is air.

12. The process of claim 9 wherein the alkali metal hydroxide coated electrode is exposed to oxygen-containing gas for at least 4 hours.

13. The process of claim 11 wherein the alkali metal hydroxide coated electrode is exposed to air for at least 4 hours.

14. A method of treating active porous nickel to prevent pyrophoricity of the porous nickel comprising coating said active porous nickel with a non-flammable, oxygen-permeable liquid film selected from the group consisting of an organic material and an aqueous solution of a non-oxidizing inorganic material and exposing the coated porous nickel to an oxygen-containing gas for a period sufficient to depyrophorize the nickel, said liquid film being chemically inert to porous nickel.

15. The method of claim 14 wherein the liquid film coated porous nickel is exposed to oxygen-containing gas for at least 4 hours.

16. The method of claim 14 wherein the liquid film is a 4 to 50 weight percent alkali metal hydroxide solution.

17. The method of claim 15 wherein the liquid film is a 4 to 50 weight percent alkali metal hydroxide solution.

18. The method of claim 14 wherein the liquid film is an 8 to 30 weight percent alkali metal hydroxide solution.

19. The method of claim 14 wherein the active porous nickel is a coating upon an electrode.

* * * * *